United States Patent [19]

Orgeron

[11] Patent Number: 4,616,735

[45] Date of Patent: Oct. 14, 1986

[54] ESCAPE DEVICE FOR USE IN HIGH-RISE STRUCTURES

[76] Inventor: Orey C. Orgeron, 706 Souvenir Gate, Lafayette, La. 70506

[21] Appl. No.: 648,770

[22] Filed: Sep. 10, 1984

Related U.S. Application Data

[63] Continuation-in-part of Ser. No. 477,143, Mar. 21, 1983, Pat. No. 4,520,900, which is a continuation-in-part of Ser. No. 438,035, Nov. 11, 1982, abandoned.

[51] Int. Cl.[4] ..... A62B 1/02

[52] U.S. Cl. ..... 182/238; 182/71; 182/233

[58] Field of Search ..... 182/231-240, 182/71, 72, 76, 82, 142, 70, 73; 254/267, 361, 377; 188/290; 137/504

[56] References Cited

U.S. PATENT DOCUMENTS

| | | | |
|---|---|---|---|
| 197,709 | 11/1877 | Winkless | 182/142 |
| 3,261,590 | 7/1966 | Beck | 182/238 |
| 3,424,196 | 1/1969 | Donner | 137/504 |
| 3,874,632 | 4/1975 | Rago | 182/75 |
| 4,512,438 | 4/1985 | Vilchek | 182/238 |
| 4,520,900 | 6/1985 | Orgeron | 182/238 |

*Primary Examiner*—Reinaldo P. Machado
*Assistant Examiner*—Alvin Chin-Shue
*Attorney, Agent, or Firm*—Keaty & Keaty

[57] ABSTRACT

A fire escape device is disclosed for use in lowering persons from high-rise structures. The device comprises a frame having a spool rotatably mounted thereon, with a cable being wound around the spool. There is a first sprocket wheel fixed to the spool and a second sprocket wheel disposed on a fluid pump adjacent the spool. The first sprocket rotates as the cable is dispensed from the spool, thereby driving the small sprocket wheel on the fluid pump. The small sprocket wheel is provided with means for moving fluid through a fluid circuit in which a pressure compensated flow control valve is disposed for maintaining a constant speed of revolution of the spool independently of the weight of a person being lowered to the ground by the cable being unwound from the spool. In some embodiments a fluid reservoir is provided in the fluid reservoir for cushioning shock waves and breaking up bubbles. A rescue collar attached to the cable can be stored in a box around the frame, the box having a trap door in the bottom through which the collar falls when a rip cord is pulled.

11 Claims, 9 Drawing Figures

ESCAPE DEVICE FOR USE IN HIGH-RISE STRUCTURES

CROSS-REFERENCE TO RELATED APPLICATIONS

This application is a continuation-in-part of co-pending application Ser. No. 477,143, filed 03-21-83, issued 06-04-85, U.S. Pat. No. 4,520900, which is in turn a continuation-in-part of co-pending application Ser. No. 438,035, filed 11-11-82, abandoned 06-2-84, both of which are incorporated by reference as fully as if they appeared herein.

BACKGROUND OF THE INVENTION

1. Field of the Invention

This invention concerns fire escape devices for use in lowering persons from high-rise buildings. More particularly, it concerns fire escape devices using fluid pumps which avoid dependence on electrical power.

2. Discussion of the Background of the Invention

The prior art has severe problems in dealing with three major characteristics of emergency escape situations from high-rise buildings.

The first is that emergency events requiring evacuation, such as fire, earthquake or sudden structural failure, usually causes an interruption in the supply of utilities such as electrical power.

The second major problem in such an emergency situation is that the people who must be evacuated cannot be assumed to be in any particular physical condition or have any specified qualifications. A practical escape apparatus must allow for people who have limited strength, are handicapped, or who are relatively immobile.

Additionally, an evacuation emergency will induce panic, making it more difficult for persons being evacuated to perform complex tasks. A simple, straightforward escape device is required to meet the needs of persons in a panic situation.

Elevators have been excluded as an escape apparatus both because of their known propensity to be damaged by the loss of electrical power and because their control will fail catastrophically during a fire. They are so dangerous that they are posted with signs according to standard safety regulations prohibiting their use during such an emergency.

Evacuations normally involve one of three techniques. The first and oldest technique is individual descent from the building by use of various forms of escape ladders or stairs. It should be obvious that in a high-rise building, defined as one having more than approximately eight to ten stories, a significant number of the people will lack the strength to descend such a ladder, and panic will result in piling up of people, falls, and serious injury during the long descent. Fire escape stairs, integrally built into a high-rise building, are additionally notorious during a fire where many people lose their lives. In addition, persons who are handicapped simply cannot use such an escape means.

The second technique is removal by external escape devices. Ground based devices are all functionally "cherry picker"-like assemblies which can be raised from the ground, but which are ultimately limited to about the first four to five floors of any building. This renders them useless in the case of a high-rise escape situation. Helicopter escape is impractical except for removing people from the flat roof of a building while turbulence encountered in a fire situation often renders the operation of a helicopter in close proximity to a burning building extremely risky.

The third technique involves a single person brake and descent device. As shown by U.S. Pat. No. 3,844,377 or U.S. Pat. No. 2,873,055, these devices comprise individual escape harnesses suspended from a cable which is paid out from a brake mechanism.

The '055 patent shows a friction brake. Such a mechanism is affected by the fact that, as standing friction exceeds sliding friction, it tends to lock up. Thus there must be a controlled means to release the brake to start descent; thereafter controlled descent depends both on the continued maintenance of a minimum sliding friction and the lack of failure in the controller. Since, by design, the controller must be capable of releasing braking force, there is always the chance that the apparatus will fail, releasing the brake and dropping the evacuee to his doom.

The '377 patent shows a powered descent device which requires a driving means and a power source. This apparatus employs an electric motor and a battery. Such devices require constant maintenance, must be isolated from building utility services due to the high probability of failure during an emergency, and are prone to failure, trapping victims and preventing escape.

U.S. Pat. No. 4,018,423 issued to Belew avoids the friction braking problem by using a vane rotating in a closed fluid cylinder. While this disclosure avoids the runaway problem of friction brakes, it is essentially a torque converter that developes torque as a function of rotational velocity. Increasing the descent load of such a device increases the velocity of descent. Such an apparatus is, by design, restricted to a single optimum weight load.

It is an object of the present invention to overcome these constraints of the prior art and provide a more realistic escape apparatus.

First, since the occupancy of a high-rise building is variable, unpredictable, and often high, it is an object of this invention to provide an escape apparatus which will provide a uniformly controlled emergency descent under widely varying conditions of load.

It is a second object of this invention to provide an apparatus which can be used safely by people during a panic situation, without requiring physical skill or strength on the part of the user and without requiring the mastery of a complex operational process.

It is another object to provide an escape apparatus that will remain functional during prolonged storage with limited maintenance. This invention will, in fact, continue to function reliably in the event of no maintenance. It is thus an important aspect of this device that it does not require the presence of any utility services from the building, nor does it require skill, knowledge, or training on the part of the users, and it will continue to function reliably even after an extended period in storage.

SUMMARY OF THE INVENTION

The invention comprises a frame having a spool rotatably mounted on the frame with a cable wound around the spool. A first sprocket wheel is fixed to the spool to rotate with it, and a fluid pump is mounted on the frame adjacent the first sprocket wheel. The fluid pump is provided with a second sprocket wheel, the diameter of the second sprocket wheel being less than the diameter of first sprocket wheel. The second sprocket wheel is connected to rotors inside the pump for moving fluid through a fluid circuit from a discharge side of the pump to a suction side of the pump when the second wheel rotates. A drive chain around the first and second sprocket wheels transmits rotational movement between these wheels. A large collar or other device for securely holding a person is attached to the cable to support a person escaping from the building. A pressure compensated flow control valve is provided in the fluid circuit for maintaining a constant flow rate through the circuit which results in a constant speed of revolution of the spool independently of the weight of the person or persons exerting a downward force on the collar and cable.

The compensated flow valve is comprised of a valve body having a transverse barrier therein that divides the body into an inlet chamber and an outlet chamber. The flow of fluid from the inlet chamber to the outlet chamber is controlled by a movable piston which responds to increasing pressure in the inlet chamber by partially blocking the flow of fluid between the chambers.

A reverse fluid flow aperture is provided in the barrier which is normally closed by a plug during the flow of fluid through the fluid circuit during descent of persons from the burning building. The plug, however, is displaced during reverse flow of fluid so that the cable can easily be rewound about the spool for multiple uses of the devices.

In some embodiments, a fluid reservoir is provided in the fluid circuit for cushioning shock waves and breaking up air bubbles in the fluid system. The reservoir is comprised of a tank divided into first and second chambers by an upright baffle, the baffle being provided with openings through which fluid may pass. Fluid moves out of the tank through an L-shaped conduit having a beveled opening on the asending leg into which fluid passes on it way out of the tank.

Some embodiments of the invention employ a pivotal boom which is mounted on the roof of buildings and which pivots between an operating position in which the boom projects outwardly from the side of the building and a stored position in which the boom is hidden from view on the top of the building. A pulley is mounted on the boom and provides a rolling surface over which the cable moves as a person is descending from the burning building.

In especially preferred embodiments, a box is placed arond the frame holding the spool, and the box provides a storage compartment for storing the collar or other person engaging means which are attached to the cable. The bottom of the box is provided with a trap door which is held in a closed position by a pin. When the building begins to burn, the pin is pulled out of a retaining position so that the trapped door opens and the collar falls out of the box.

Another aspect of some embodiments of the invention is that the cable is wound around the spool in layers so that the diameter of the inner layer is smaller than the diameter of the outer layer. Since rotation of the spool is constant per unit time as a result of the pressure compensated flow control valve, a greater length of cable is unwound from the spool per rotation as the outer layers are dispensed then when the inner layers are being unwound. Unwinding a lesser length per unit time results in an effective slowing of the descent of persons attached to the cable, thereby cushioning the descent.

The smaller radius of the second sprocket wheel on the fluid pump maintains the flow rate of fluid through the fluid circuit at a higher rate than fluid would move through the circuit if the smaller sprocket wheel were of the same diameter as the first sprocket wheel on the spool. This smaller radius maintains the flow rate high enough to produce an "overdrive" effect: the volume of fluid increases, thereby reducing pressure in the circuit and premitting use of a smaller pump.

DETAILED DESCRIPTION OF THE PREFERRED EMBODIMENT

Figure 1:
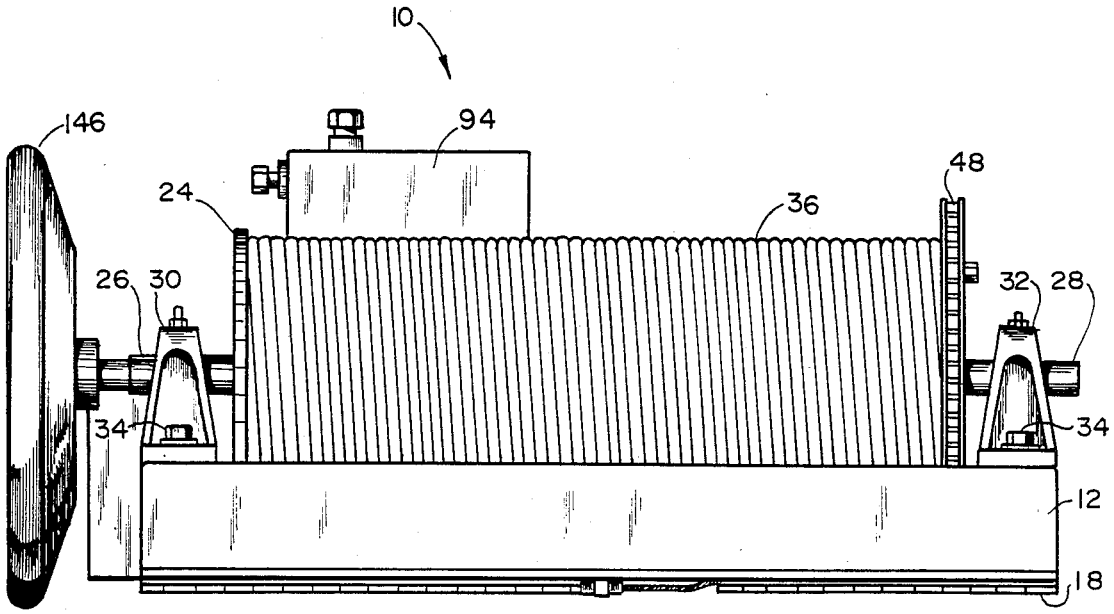
FIG. 1 is a side elevational view of the fire escape device.

A fire escape device 10 is shown in FIGS. 1–3 and 8 for use in lowering persons from high-rise structures. Device 10 is usually employed in high-rise buildings, offshore platforms, and other tall structures during a fire or other emergency when quick evacuation of the structure is required without using elevators or stairways. Device 10 comprises a frame 12 (FIGS. 1–3) enclosed by a box 14 (FIG. 8), the box having a trap door 16 on the bottom thereof connected along one edge to frame 12 by a hinge 18 (best seen in FIG. 3). Door 16 is normally held in a closed position flush with frame 12 by means of a pin 20 inserted through holder 22 attached to frame 12. The pin projects out of a circular opening in holder 22 to a point underneath door 16 so that door 16 is retained in the closed position. Pin 20 is attached to a rip cord (not shown) which can be used for removing pin 20 from holder 22 by pulling the cord form a remote location.

Figure 2:
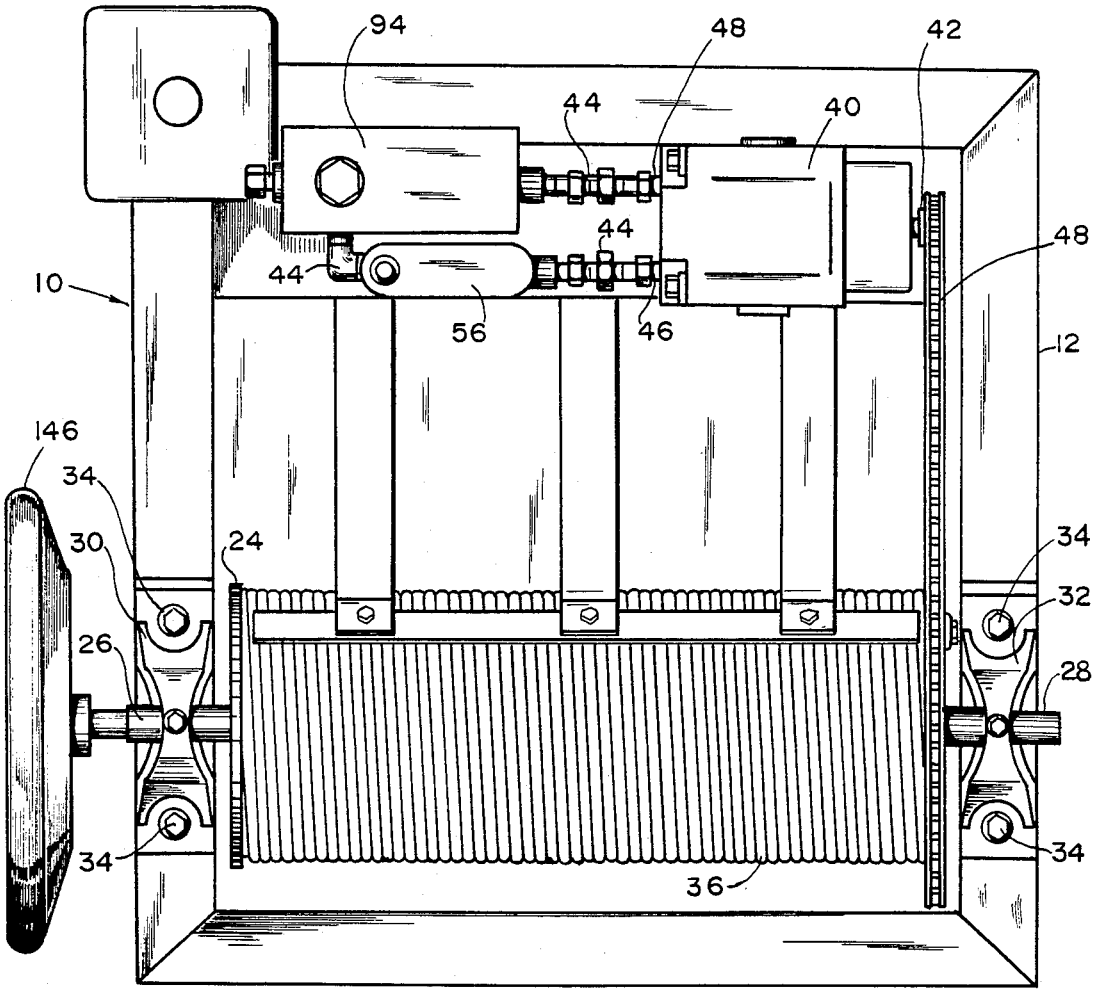
FIG. 2 is a top, plan view of the device shown in FIG. 1.
Figure 3:
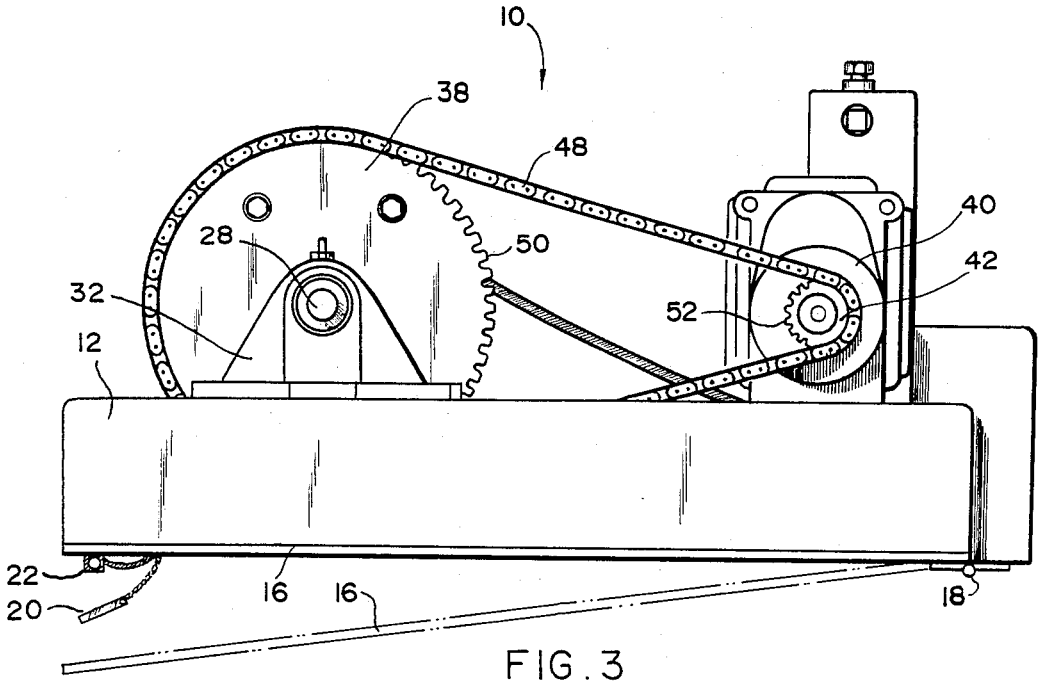
FIG. 3 is a front elevational view of the device shown in FIG. 1, the position of the trap door after opening being shown in phantom.
Figure 4:
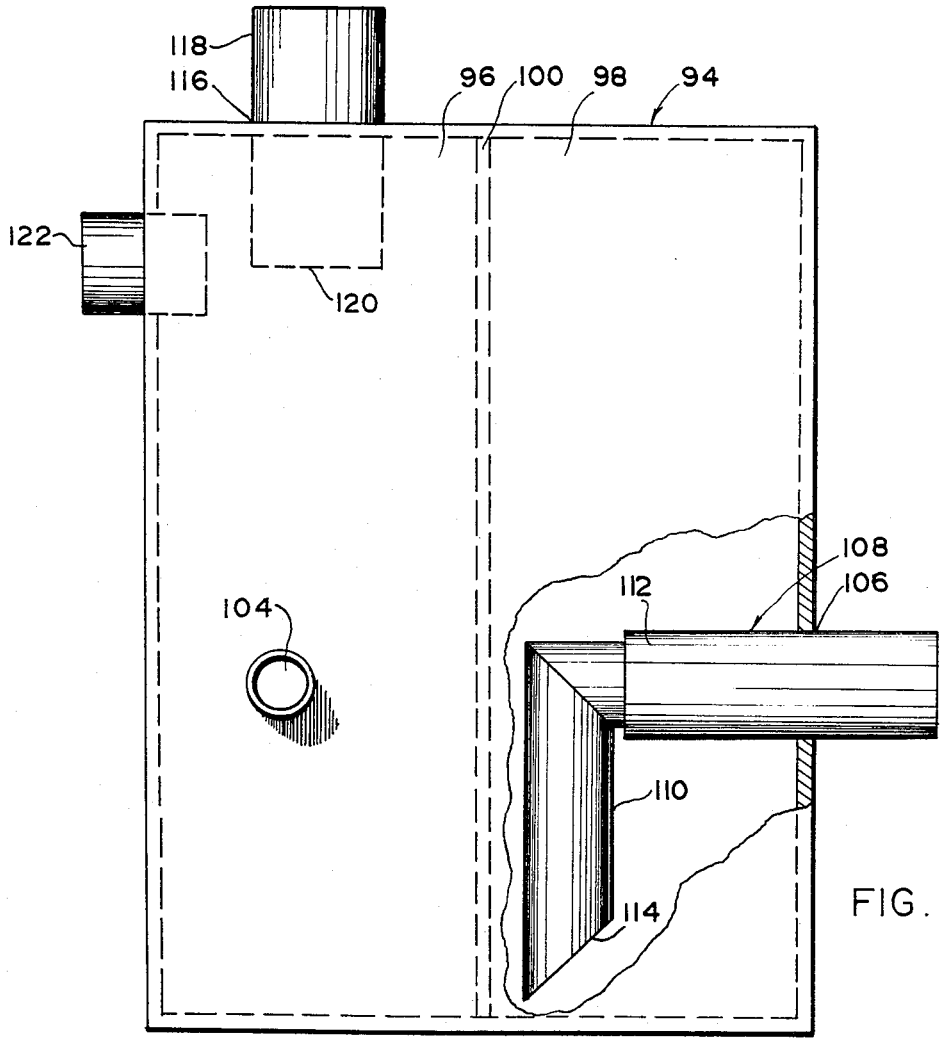
FIG. 4 is an enlarged, side view of the fluid reservoir located in the fluid circuit.
Figure 5:
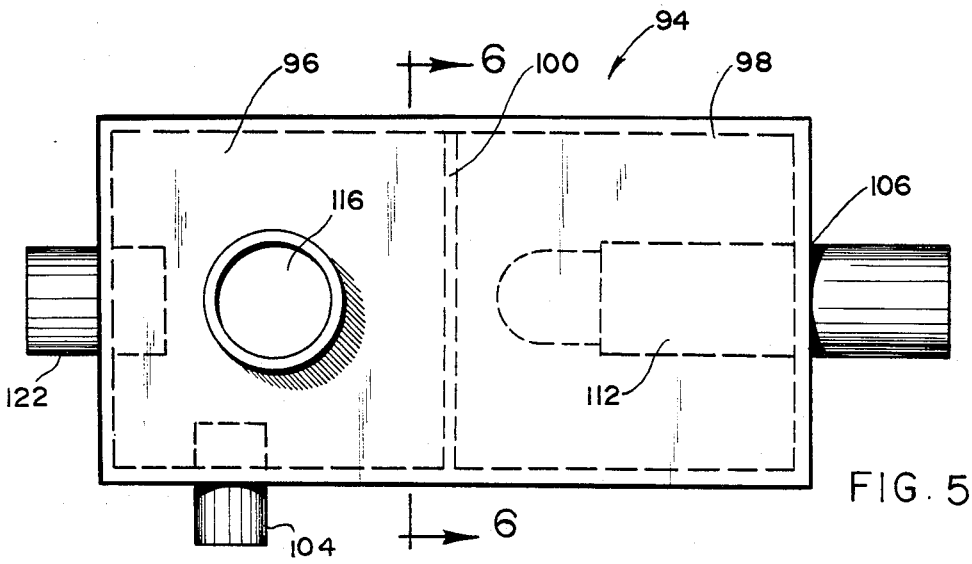
FIG. 5 is a top view of the reservoir shown in FIG. 4.
Figure 6:
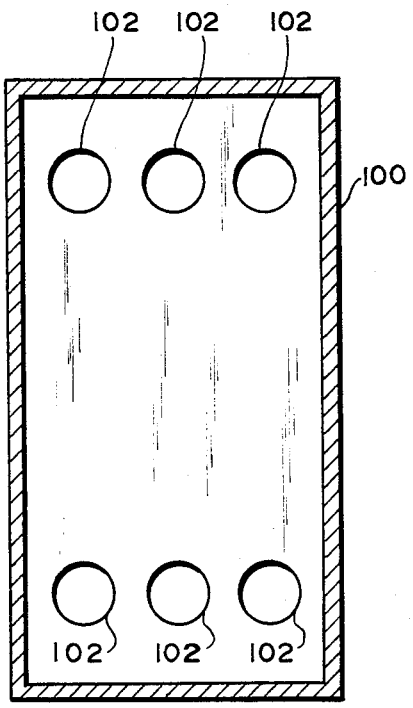
FIG. 6 is a cross-sectional view taken along section lines 6—6 in FIG. 5 showing an upright baffle in the fluid reservoir.

A spool 24 (FIGS. 1 and 2) is rotatably mounted on frame 12 by placement of projections 26, 28 through holders 30, 32 respectively. Holders 30, 32 are bolted to frame 12 with hexagonal nuts 34, as best seen in FIG. 2.

A cable 36 is wound around spool 24 in layers so that the outer layer of cable 36 has an effectively greater radius than the inner layer. A first sprocket wheel 38 is fixed to spool 24 (FIG. 3) for rotation with spool 24. A fluid pump 40 is disposed on frame 12 adjacent spool 24, pump 40 being provided with a second sprocket wheel 42, the central axis of which is parallel to the central axis of spool 24. The diameter of second sprocket wheel 42 is less than the diameter of first sprocket wheel 38, the ratio of the radii of large sprocket wheel 24 to small sprocket wheel 42 being, in preferred embodiments, 4.5:1. Second wheel 42 is connected by means of a shaft to a rotor inside fluid pump 40, rotation of second sprocket wheel 42 rotating the rotors to move fluid through a fluid circuit 44 comprised of high strength tubing from a discharge side 46 to a suction side 48 of pump 40 when second wheel 42 rotates. It should be understood that the fluid can flow both directions in circuit 44, the direction of flow depending on the direction of rotation of second wheel 42.

A drive chain 48 is fixed around first and second wheels 38, 42, chain 48 positively engaging the sprockets 50 on first wheel 38 and the sprockets 52 on second wheel 42. Chain 48 transmits rotational movement between wheel 38 and wheel 42. For example, rotation of wheel 38 in a clockwise direction would move chain 48 with wheel 38 to impart a clockwise rotation to wheel 42. The smaller radius of wheel 42 would cause wheel 42 to rotate several times for each rotation of larger first wheel 38.

Figure 8:
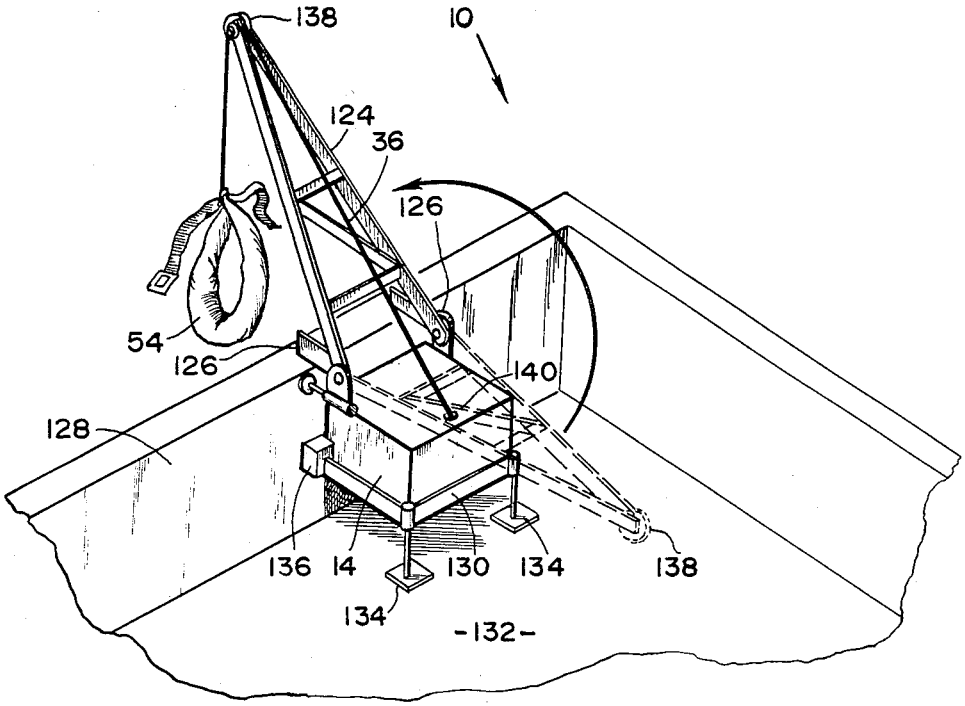
FIG. 8 is a pivotal boom mounted on the top of a high-rise building, the stored position of the boom being shown in phantom.

As best seen in the embodiment of FIG. 8, a rescue collar 54 is attached to one end of cable 36 that is not fixed to spool 24. Collar 54 is capable of being stored inside box 14 and is retained in box 14 when door 16 is held in its closed position by pin 20. Collar 54 is preferably similar to life jackets used, for example, by the Coast Guard for helicopter rescues.

Any device capable of carrying the human body can be attached to cable 36 in place of collar 54. For example, applicant's co-pending applications disclose a large box which is attached to cable 36 inside which a person may be carried from the top of a building to the ground.

A pressure compensated flow control valve 56 is located in circuit 44 for maintaining a constant speed of revolution of spool 24 independently of the weight of persons carried by collar 54 which exerts a downward force on collar 54 and cable 36.

Figure 7:
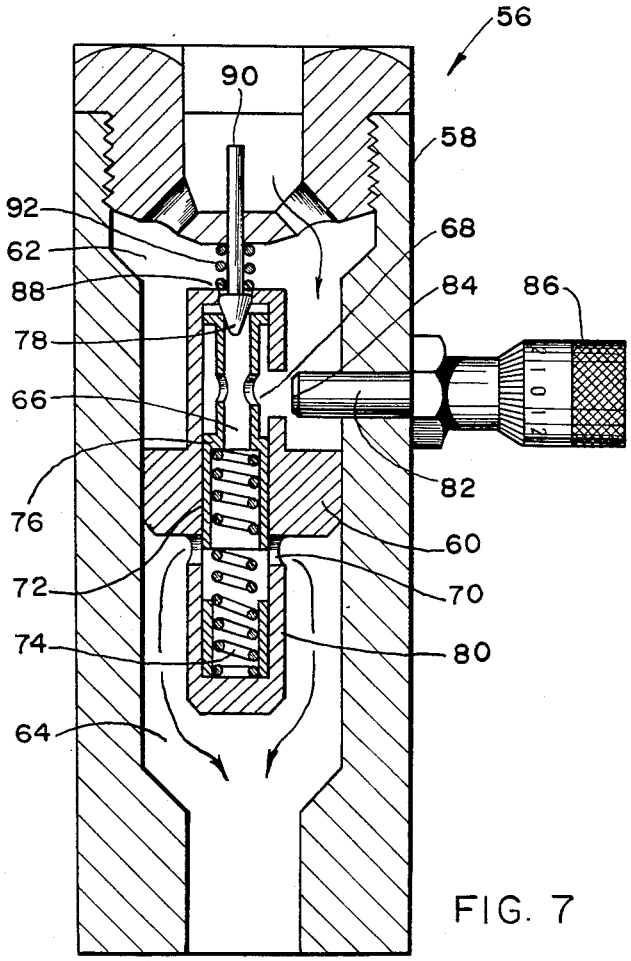
FIG. 7 is an enlarged, cross-sectional view of a pressure compensated flow control valve in the fluid circuit.

Valve 56, which is shown in detail in FIG. 7, comprises a valve body 58 divided by a barrier 60 into an inlet chamber 62 and outlet chamber 64. The numeral 60 refers both to the longitudinal and transversely extendinng portions of the barrier. A passageway, which is generally designated by the numeral 66, is provided through barrier 60, the passageway 66 having a first opening 68 between the inlet chamber and the passageway and a second opening 70 between outlet chamber 64 and passageway 66. A movable piston 72 is provided between first opening 68 and second opening 70 so that an increase of pressure in inlet chamber 62 moves piston 72 into at least partially obstructive relationship to the flow of fluid through second opening 70, thereby slowing the flow of fluid through the fluid circuit and braking the descent of collar 54. Piston 72 is comprised of a larger diameter annular portion and a smaller diameter annular portion, the larger diameter annular portion having a helical spring 74 disposed therein which rests against the shoulder 76 formed by the reduction in diameter of the annular portions of piston 72. The force of this pressure is exerted against annular flange 78 and shoulder 76 to move piston 72 against the bias of spring 74. This movement of piston 72 causes edge 80 of piston 72 to obstruct second opening 70 and reduce the flow of fluid through circuit 44.

A rod 82 is disposed through an opening in body 58 so that rod 82 has a hole plugging end 84 adjacent first opening 68. Rod 82 is coupled to a calibrated dial 86, the rotation of which advances or retracts end 84 towards or away from first opening 68. Adjustment of dial 86 can therefore predetermine the amount of fluid which flows from inlet chamber 62 into passageway 66 and alter the speed of fluid flow through circuit 44. In preferred embodiments the flow rate varies from 4 to 12 gallons per minute.

A reverse fluid flow aperture 88 is provided in barrier 60, aperture 88 being closed by a plug 90 during flow of fluid through circuit 44 when fluid is flowing from inlet chamber 62 to outlet chamber 64 during descent of the engaging means. Plug 90 can be displaced during reverse flow of fluid through circuit 44 when cable 36 is being rewound around spool 24. Plug 90 is normally spring biased in closing relationship with aperture 88 by a spring 92, the spring constant 92 around plug 90 being lower than the spring constant of spring 74 biasing piston 72 out of obstructing relationship to second opening 70 so that plug 90 is displaced more easily against the bias of spring 92 than piston 74 moves against the bias of its spring 74. The overall result is that reverse fluid flow from outlet chamber 64 to inlet chamber 62 is accomplished much more easily than fluid flow in the forward direction from inlet chamber 62 to outlet chamber 64 which occurs when collar 54 is lowering a person to the ground.

A tank 94 is provided in fluid circuit 44, tank 94 being divided into first and second chambers 96, 98 by an upright baffle 100 which is provided with a plurality of openings 102 through which fluid may pass. Tank 94 is provided with an orifice 104 in first chamber 96 for permitting introduction of fluid from fluid circuit 44 into first chamber 96 and an orifice 106 in second chamber 98 through which fluid leaves second chamber 98 and reenters fluid circuit 44. An L-shaped conduit 108 is disposed in second chamber 98, conduit 108 having an ascending leg 110 and a level leg 112 through which fluid leaving second chamber 98 passes on its way back into fluid circuit 44. The bottom of leg 110 is beveled with the angle of the bevel being in the direction of orifice 106. This bevel 114 helps move fluid through conduit 106 with less fluid resistance.

Tank 94 is provided with a filling hole 116 through which fluid is initially placed in the tank. In preferred embodiments, fluid fills tank 94 to a level approximated by the bottom 120 of a conduit 118 which is placed in hole 116. This level can be viewed through view glass 122.

As best seen in FIG. 8, preferred embodiments of the invention provide a boom 124 mounted on pivots 126 which are fixed, by bolts or the like, to an upwardly projecting wall 128 on top of a high-rise structure. Box 14 is similarly secured to wall 128 by means of a brace 130 which is fixed to the flat surface 132 of the roof at plates 134. Brace 130 is similarly fixed to wall 128 at attachments 136. A pulley 138 is rotatably mounted at the apex of triangularly-shaped boom 124, cable 36 fitting within a groove of pulley 138 so that cable 36 moves over pulley 138.

Boom 124 pivots between an operating position (shown in dark lines in FIG. 8) in which boom 124 projects beyond wall 128, and a stored position (shown in phantom) in which boom 124 is horizontally disposed on top of box 14.

Cable 36 emerges from box 14 through hole 140 on top of box 14.

Figure 9:
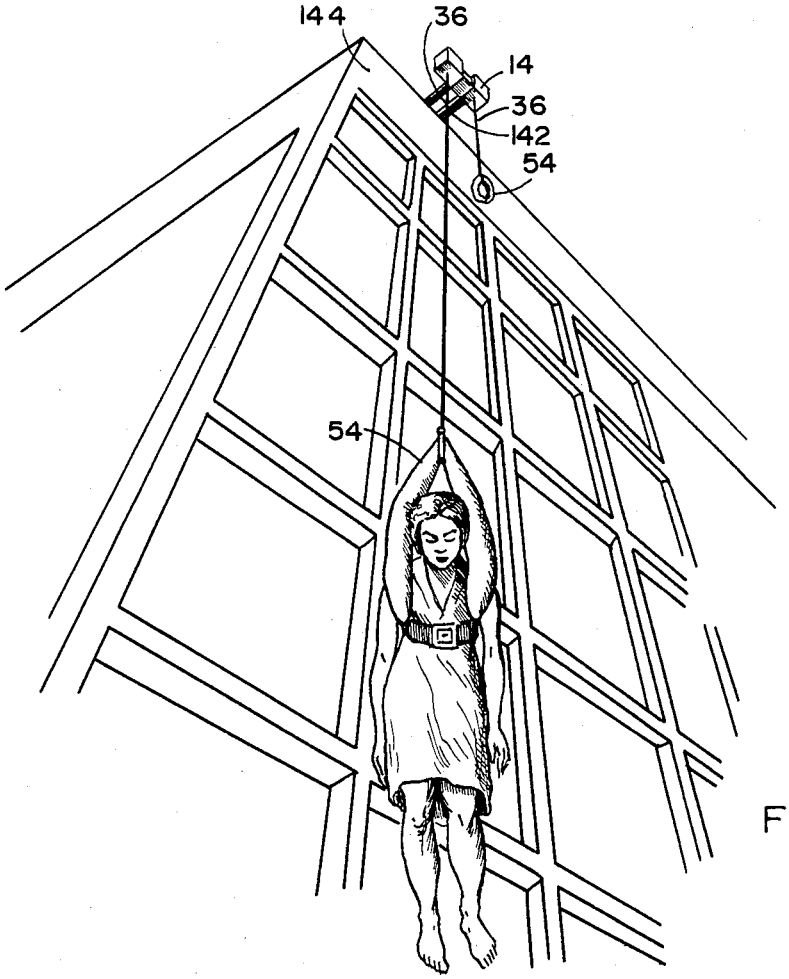
FIG. 9 is a view of an alternate embodiment of the invention in which the fire escape device is placed on a rigid strut extending outwardly from the side of the building.

Another embodiment of the invention is shown in FIG. 9 in which jackets 54 are attached by means of cable 36 to box 14 which is mounted on a horizontal strut 142 that extends outwardly from the sidewall 144 of a high-rise building shown in FIG. 9.

In operation, a person desiring to escape a high-rise structure pulls a rip cord attached to pin 20 which removes pin 20 from its obstructing relationship to door 16, so that door 16 pivots downwardly around pivot 18 to open the bottom and permit jacket 54 to fall therethrough. A user then places jacket 54 under his arms, in the fashion shown in FIG. 9, and steps over the edge of the building to begin his descent to the ground. The downward weight of the person exerted on jacket 54 is transmitted through cable 36 to begin unwinding cable 36 from around spool 24, thereby imparting clockwise rotation to spool 24. Clockwise movement of spool 24 moves wheel 38 in a clockwise direction in the embodiment shown in FIG. 3. Clockwise movement of wheel 38 imparts a clockwise rotation to wheel 42, but wheel 42 rotates faster than wheel 38 because of the differences in diameter therebetween. As wheel 42 rotates, rotors inside fluid pump 40 move fluid into circuit 44 through outlet 46. Rotation of spool 24 continues until the end of the cable (which is fixed to spool 24) is reached or until the user reaches the ground and downward force on cable 36 stops.

Fluid moving through circuit 44 enters valve 56 when it passes into chamber 62, through opening 68, into passageway 66 and out of opening 70, whence it moves through outlet chamber 68 and once again into circuit 44. An increase in pressure in chamber 62 will cause piston 72 to move against the bias of spring 74 so that edge 80 moves into at least partially obstructing relationship to second opening 70, thereby reducing the flow of fluid through valve 56. The amount of fluid flowing into first opening 68 and through passageway 66 can further be controlled by rotating dial 86 to advance or retract end 84 of rod 82 which is disposed in plugging engagement to first opening 68. Dial 86 permits the speed of descent to be preset while piston 72 keeps the flow of fluid through circuit 44 constant regardless of the weight of a person or persons attached to the collar 54 or other person engaging means on the end of cable 36. Valve 56 accordingly ensures that the speed of rotation of spool 24 remains constant.

Since cable 36 is wound around spool 24 in layers, the effective radius of an outer layer of cable is greater than the effective radius of an inner layer of cable. This means that a greater length of cable is unwound for each rotation of spool 24 when the top layers are unwinding than is unwound when lower layers unwind. Since rotation of spool 24 is constant, the speed of descent of a person will be greater in the beginning of the descent and slower as the person nears the ground. This slowing of descent has an effect of making a person's landing easier.

Once fluid leaves valve 56, it can in some embodiments pass through tank 94 by entering through orifice 104 in the side of tank 96. A cushion of air on top of fluid in tank 96 provides a place for bubbles in the fluid to move, while shock waves in the system, such as waves caused by the system being started, are absorbed by baffle 100. Baffle 100 creates turbulent flow within the system, therefore releasing any air bubbles that may be in circuit 44. If such turbulence were not created, streamline flow could entrap the air. Tank 96 also provides room for expansion of fluid in circuit 44.

In the embodiment shown in FIG. 8 a trap door is not necessary. Boom 124 is merely pivoted about pivots 126 from its horizontal stored position to its operating position wherein boom 124 projects at an angle outwardly over walls 128 of the building. A person can place collar 54 underneath his arms and then step over wall 128 to begin his descent to the ground. After the emergency is over, boom 124 can be rotated about pivots 126 to its horizontal stored position for use in future emergencies. Cable 36 can also be rewound about spool 24 by turning handle 146 (FIGS. 1–2) in a counterclockwise direction to place cable 36 in layers on spool 24. Counterclockwise rotation is facilitated by movement of plug 90 out of plugging engagement with aperture 88 against the bias of spring 92. Reverse flow of fluid through circuit 44 is thereby made easier. Rewinding can be easily accomplished by manual or battery actuated means to permit device 10 to be used quickly afterwards for escape of more persons from the building.

FIG. 9 shows an alternate embodiment of the invention in which boxes 14 having trap doors 16 are placed on horizontal struts 142 which permanently project outwardly from the side wall 144 of a building. Trap door 16 can be opened by pulling a rip cord attached to pin 20, causing collar 54 to fall out of box 14 and become available for use. A user can then place collar 54 around his body in a fashion similar to that described in FIG. 8, and begin the downward descent in a similar fashion. Descent will be at a somewhat constant speed regardless of the weight of the person, the only change in velocity of descent being the deceleration experienced as a result of cable being wound in layers of increasing radii around spool 24.

As described in co-pending applications, other person-engaging structures such as elevator-type boxes or a plurality of collars can be attached to cable 36 in lieu of collar 54. These large boxes or collars could accommodate from one to several people, making valve 56 quite important in controlling the rate of descent of such a person-engaging means.

Device 10 can be used on many structures from which an emergency descent may be required. For example, the device is ideal on drilling derricks to assist in evacuation of personnel from the derrick. Since a person being evacuated from such a derrick would desire to move away from the derrick floor at the same time he is moving downwardly from it, a cable can be attached to the floor at one end and then run at an angle outwardly away from the floor where it can be attached to another structure. This cable can be used as a guide outwardly away from the floor during descent. The reason for this outward descent is that a driling derrick is normally tapered wide at the bottom and narrow at the top.

The disclosure of the preferred embodiment has been made in accordance with requirements of the patent law, and is not intended to limit the scope of the invention defined in the following claims.

I claim:

1. A fire escape device for use in lowering persons from high-rise structures, comprising:

a frame;

a spool rotatably mounted on the frame;

a cable wound around the spool;

a first sprocket wheel fixed to the spool for rotation therewith;

a fluid pump mounted on the frame and provided with a second sprocket wheel, the diameter of the second sprocket being less than the diameter of the first sprocket wheel, the second sprocket wheel being provided with the means for moving fluid through a fluid circuit from a discharge side to a suction side of the pump when the second wheel rotates;

a drive chain around the first and second sprocket wheels for transmitting rotational movement between the first and second sprocket wheels;

person engaging means attached to the cable;

a pressure compensated flow control valve in the fluid circuit for maintaining a constant speed of revolution of the spool independently of a weight exerting a downward force on the engaging means, wherein said compensated flow valve comprises a valve body with an inlet and an outlet, the valve body being divided by a barrier into an inlet chamber and an outlet chamber, the barrier preventing flow of fluid from the inlet to the outlet, the barrier being provided with a passageway therethrough, a first opening between the inlet chamber and the passageway and a second opening between the passageway and the outlet chamber, a movable piston between the first and second openings, an increase of pressure in the inlet chamber moving the piston into at least partially obstructive relationship to the flow of fluid through the second opening, thereby slowing the flow of fluid through the fluid circuit and breaking descent of the engaging means, the degree to which the piston obstructs the second opening being proportional to the pressure in the inlet chamber, the piston is spring biased into normally non-obstructive relationship to the flow of fluid through the second opening, the bias of the spring being overcome by increased pressure on the inlet side of the barrier to move the piston into at least partially obstructive relationship to the flow of fluids through the second opening; and means for selectively, at least partially, obstructing the flow of fluid through the first opening, wherein the means for at least partially obstructing the flow of fluid into the first opening comprises a rod having a hole-plugging end adjacent the first opening, and means outside the valve body for selectively moving the plugging end into obstructing relationship with the first opening, wherein a reverse fluid flow aperture is provided in the barrier, the aperture being closed by a plug during flow of fluids through the fluid circuit during descent of the engaging means, the plug being displaced during reverse flow of fluid when rewinding the cable around the spool, wherein the plug is normally spring biased into closing relationship with the aperture, the spring constant of the spring around the plug, being lower than the spring constant of the spring biasing the piston out of obstructing relationship to the second opening, so that the plug is displaced more easily against the bias of its spring than the piston moves against the bias of its spring.

2. The device of claim 1 wherein a fluid reservoir is provided in the fluid circuit for cushioning shock waves and breaking up air bubbles in the fluid system.

3. The device of claim 2 wherein the fluid reservoir is comprised of:

a tank divided into first and second chambers by an upright baffle, the baffle being provided with openings through which fluid may pass;

an orifice in the first chamber for permitting introduction of fluid from the fluid circuit into the first chamber; and an orifice in the second chamber through which fluid leaves the second chamber and enters the fluid circuit.

4. The device of claim 3 wherein fluid moves through the orifice in the second chamber by passing through an L-shaped conduit having an ascending leg and a level leg, the opening in the ascending leg into which fluid passes being beveled.

5. The device of claim 4 further comprising:

a pivotal boom mounted adjacent the device which pivots between an operating position in which the boom at least partially projects from the side of the building and a stored position; and a pulley mounted on the boom and over which the cable moves.

6. The device of claim 5 wherein a box is provided around the frame, the box providing a storage compartment for storing the engaging means when the device is not in use.

7. The device of claim 6 wherein:

a door is provided in the bottom of the box through which the engaging means falls when the door is open.

8. A fire escape device for use in lowering persons from high-rise structures, comprising:

a frame enclosed by a box, the box having a door in the bottom thereof;

a spool rotatably mounted on the frame;

a cable wound around the spool in layers so that the outer layer of cable has an effectively greater radius than the inner layer;

a first sprocket wheel fixed to the spool for rotation therewith;

a fluid pump mounted on the frame and provided with a second sprocket wheel, the diameter of the second sprocket wheel being less than the diameter of the first sprocket wheel, the second sprocket wheel being provided with means for moving fluid through a fluid circuit from a discharge side to a suction side of the pump, the ratio of the diameter of the first sprocket wheel to the diameter of the second sprocket wheel being about 4.5:1;

a drive chain around the first and second sprocket wheels for transmitting rotational movement between the first and second sprocket wheels;

person engaging means attached to the cable incapable of being stored in the box when the door in the bottom of the box is closed;

a compensated flow valve in the fluid circuit for maintaining a constant speed of revolution of the sppol independently of a weight exerting a downward force on the person engaging means, the valve comprising a valve body with an inlet and an outlet, the valve body being divided by a barrier into an inlet chamber and an outlet chamber, a passageway through the barrier provided with a first opening between the inlet chamber and passageway and a second opening between the outlet chamber and passageway, a movable piston being provided between the first and second openings so that an increase of pressure in the inlet chamber moves the piston into at least partially obstructive relationship to the flow of fluid through the second opening, thereby slowing the flow of fluid through the fluid circuit and braking the descent of the engaging means, the degree to which the piston obstructs the second opening being proportional to the pressure in the inlet chamber, the movable piston being normally biased into non-obstructive relationship to the flow of fluid through the second opening, the bias of the spring being overcome by increased pressure on the inlet side of the barrier to move the piston into at least partially obstructive relationship to the flow of fluid through the second opening;

a rod having a hole plugging end adjacent the first opening and means outside the valve body for selectively moving the plugging end into at least partially obstructing relationship to the flow of fluid through the first opening;

a reverse fluid flow aperture in the barrier, the aperture being closed by a plug during flow of fluid through the fluid circuit during descent of the engaging means, the plug being displaced during reverse flow of fluid when the cable is being rewound around the spool, the plug being normally spring biased by a sourrounding spring into closing relationship with the aperture, the spring constant of the spring around the plug being lower than the spring constant of the spring biasing the piston out of obstructing relationship to the second opening so that the plug is displaced more easily against the bias of its spring than the piston moves against the bias of its spring;

a tank provided in the fluid circuit, the tank being divided into first and second chambers by an upright baffle, the baffle being provided with an opening through which the fluid may pass, the tank having an orifice in the first chamber for permitting introduction of fluid from the fluid circuit into the first chamber and an orifice in the second chamber through which fluid leaves the second chamber and reenters the fluid circuit, the tank being provided with an L-shaped conduit having an ascending leg and a level leg through which fluid leaving the second chamber passes, the bottom of the ascending leg being beveled.

9. The device of claim 8 further comprising:

a pivotal boom mounted adjacent the device which pivots between an operating position in which the boom at least partially projects from the side of the structure and a stored position; and a pulley mounted on the boom and over which the cable moves.

10. A fire escape device for use in lowering persons from high-rise structures, comprising:

a frame enclosed by a box, the box having a door in the bottom thereof;

a spool rotatably mounted on the frame;

a cable wound around the spool in layers so that the outer layer of cable has an effectively greater radius than the inner layer;

a first sprocket wheel fixed to the spool for rotation therewith;

a fluid pump mounted on the frame and provided with a second sprocket wheel, the second sprocket wheel being provided by means for moving fluid through a fluid circuit from a discharge side to a suction side of the pump when the second wheel rotates, the ratio of the diameter of the first sprocket wheel to the diameter of the second sprocket wheel being about 4.5:1;

a drive chain around the first and second sprocket wheels for transmitting rotational movement between the first and second sprocket wheels;

person engaging means attached to cable and capable of being stored in the box when the door in the bottom of the box is closed;

a pressure compensated flow control valve in the fluid circuit for maintaining a constant speed of revolution of the spool independently of a weight exerting a downward force on the person engaging means, the valve comprising a valve body having an inlet and an outlet, the valve body being divided by a barrier into an inlet chamber and an outlet chamber, a passageway being provided through the barrier having a first opening between the inlet chamber and passageway and a second opening between the outlet chamber and passageway, a movable piston being provided between the first and second openings so that an increase of pressure in the inlet chamber moves the piston into at least partially obstructive relationship to the flow of fluid through the second opening, thereby slowing the flow of fluid through the fluid circuit and braking the descent of the engaging means, the movable piston being normally biased into non-obstructive relationship to the flow of fluid through the second opening, the bias of the spring being overcome by increased pressure on the inlet side of the barrier to move the piston into at least partially obstructive relationship to the flow of fluid through the second opening;

a rod having a hole plugging end adjacent the first opening and means outside the valve body for selectively moving the plugging end into at least partially obstructing relationship to the flow of fluid through the first opening;

a reverse fluid flow aperture in the barrier, the aperture being closed by a plug during flow of fluid through the fluid circuit during descent of the engaging means, the plug being displaced during reverse flow of fluid when the cable is being rewound around the spool, the plug being normally spring biased by a sourrounding spring into closing relationship with the aperture, the spring constant of the spring around the plug being lower than the spring constant of the spring biasing the housing out of obstructing relationship to the second opening so that the plug is displaced more easily against the bias of its spring than the housing moves against the bias its spring;

11. The device of claim 10 further comprising:

a pivotal boom mounted adjacent the device which pivots between an operating position in which the boom at least partially projects from the side of the structure and a stored position;

a pulley mounted on the boom and over which the cable moves.

* * * * *